US005839031A

United States Patent [19]

Waterschoot et al.

[11] Patent Number: 5,839,031

[45] Date of Patent: Nov. 17, 1998

[54] ELECTROSTATOGRAPHIC DEVELOPING DEVICE

[75] Inventors: William Waterschoot, Belsele; Leo Vackier, 's-Gravenwezel; Robert Janssens, Geel; Luc Van Goethem, Sint-Gillis-Waas; Eric Van Echelpoel, Lier, all of Belgium

[73] Assignee: Agfa-Gevaert, Mortsel, Belgium

[21] Appl. No.: 855,673

[22] Filed: May 14, 1997

[51] Int. Cl.[6] ..... G03G 15/04

[52] U.S. Cl. ..... 399/119; 399/222; 399/227

[58] Field of Search ..... 399/110, 119, 399/107, 222, 227

[56] References Cited

U.S. PATENT DOCUMENTS

| | | | |
|---|---|---|---|
| 4,922,301 | 5/1990 | Katoh et al. | 399/227 |
| 5,198,866 | 3/1993 | Kimura et al. | 399/222 |
| 5,325,151 | 6/1994 | Kimura et al. | 399/227 |
| 5,565,973 | 10/1996 | Fujishiro et al. | 399/227 |

*Primary Examiner*—Arthur T. Grimley
*Assistant Examiner*—Hoan Tran
*Attorney, Agent, or Firm*—Baker & Botts, L.L.P.

[57] ABSTRACT

An electrostatographic developing device having a developer chamber (26), a toner chamber (21), a dosage reservoir (9) and a developer roller (13) mounted within a rotatable housing (11).

5 Claims, 12 Drawing Sheets

ELECTROSTATOGRAPHIC DEVELOPING DEVICE

FIELD OF THE INVENTION

The present invention relates to electrophotography in general, and to a device, in particular for use in developing electrostatic images formed on the surface of an electrostatic image support member in an electrophotographic process.

DESCRIPTION OF THE ART

In electrostatic latent image developing devices it is known to transport the developing material, called the "developer" hereinafter, which is supported in the form of a magnetic brush on the outer peripheral surface of a developing sleeve in a circumferential direction of said sleeve so as to develop an electrostatic image formed on an electrostatic latent image support member by causing the developer to rub against the surface of said support member at a developing area where said developing sleeve and said electrostatic latent image support member confront each other.

The developer is supplied to the rear side of the developing sleeve in connection with the developing area thereof, and at the time of supplying it is required that the developer (usually composed of a mixture of carrier and toner) has been fully mixed and stirred, with toner particles therein being sufficiently triboelectrically charged, and sufficiently uniformly distributed along the length of the sleeve.

In order to satisfactorily mix and stir the developing material, it is known to use neighbouring feeding passages running parallel to the developer sleeve, through which the developer is fed in opposed directions by means of screw feed rollers disposed in each feeding passage, thereby to circulate the developing material through end openings in a partition wall which separates the feeding passages. Between the screw feed circulation system and the magnet roller there is a buffer of developer. Suchlike arrangement is disclosed e.g. in U.S. Pat. No. 5,142,333 assigned to the present assignee.

In operation of the developing device, the magnet roller is consuming developer out of the buffer and returning depleted developer thereto. The screw feeders are circulating the buffer, and are mixing and charging toner which is added to compensate for toner depletion by the charged image.

The described arrangement has the following disadvantages.

Because of screw feed circulation and buffer depletion an inherent left/right difference in toner concentration is built in. This toner concentration gradient is growing proportionally to the toner consumption by the electrostatic charge image.

Ghost images can appear because the depleted developer is dumped in the buffer which is re-used immediately without compensation for depletion.

A further problem with this and other known developing equipment is that satisfactory operation is obtained only for an area coverage varying between 15 and 30%. For higher area coverages there occur density variations from one to the other lateral edge of the image, caused by differences in charge and/or toner concentration of the developer.

High image contrasts require high toner additions, which gives rise to toner charging problems with resulting dust, fog, insufficient resolution and insufficient toner transfer.

Electrostatic developing devices are known comprising means for completely removing developer from the magnet roller at a position downstream of the developing area but upstream of the place where fresh developer is supplied to the magnet. These devices allow a developer mixture of nearly constant composition to become supplied to the magnet roller so that the disadvantages mentioned hereinbefore are overcome to a large degree. Devices of the mentioned kind are disclosed in JP-A-02 110,484, JP-A-04 343,376, JP-A-53 006,034 and JP-A-02 054,284.

SUMMARY OF THE INVENTION

Object of the invention

It is the object of the invention to provide an electrostatographic developing device that affords an improved image quality, viz. density uniformity, and also allows development of more severe image contents, e.g. 100% area coverage, or extreme left to right differences in coverage, which is based on a novel constructional concept.

Statement of Invention

An electrostatographic developing device, comprising a magnet roller capable of holding on its peripheral surface a magnetically attractable dry powder developer for the development of an electrostatic charge image formed on an electrostatic image support member which is passed at a developing area in close vicinity of the magnet roller, a holder for toner, a container for developer, means for mixing said toner with said developer to produce fresh developer, means for supplying said fresh developer to said magnet roller, and means for completely removing developer from said magnet roller at a position downstream of the developing area and upstream of the position where fresh developer is supplied to said magnet roller, characterised in that said device comprising a housing which is mounted for unidirectional rotation over 360 angular degrees around a horizontal shaft, said magnet roller being mounted in a peripheral opening of said housing, the housing comprising a receiving chamber for receiving used developer removed from said magnet roller, a chamber for a supply of toner, a chamber for developer, means for the addition of toner from the toner chamber to developer in the developing chamber, and mixing means for mixing used developer and/or toner with developer in said developer chamber to produce fresh developer.

The complete "cleaning" the magnet roller after image development and the re-supplying with fresh toner prior to the next developing, makes that the developing capacity of the magnet roller is always maximum, and this for toner concentration as well as for the electrostatic charging of the developer.

The term "used" developer stands in the present description for developer removed from the magnet roller, and this independent from the fact that a given image might have been developed up to an area coverage of 100% which means a high degree of depletion of a part of the developer.

The term "developer" means the mass of developer composition as such, whereas "fresh developer" means developer to which an adequate amount of toner has been added and mixed, and which also is adequately stirred to obtain the desired electrostatic charging.

An electrostatographic developing device according to the invention can be used for developing electrostatic charge images of different kinds. A common situation is one in which the charge image is formed on a photoconductor in the form of a drum or belt which has been uniformly electrostatically charged and next imagewise exposed to leave an electrostatic charge image. Another one is that of a dielectric support onto which an electrostatic charge image has been directly applied by imagewise controlled ion deposition.

Suitable embodiments of an electrostatographic developing device according to the present invention are as follows:

the receiving chamber has an opening for inlet and outlet of used developer, which opening extends downwardly in that angular position of the housing in which said magnet roller takes its operative position, so that used developer removed from the magnet roller is kept in said chamber during rotation of said housing after developing until the magnet roller reaches again its operative position, that developing device wherein has a developer passage for guiding used developer from said magnet roller to said receiving chamber, the wall of said passage which is lowest as developer is being removed from the magnet roller being provided with ribs that converge downwardly, thereby causing a concentration of developer towards the central portion of said passage, the wall of the developer chamber which is lowest as developer is being carried by gravity through said chamber towards said magnet roller, is provided with rib means diverging in the developer transport direction towards the magnet roller thus causing a lateral spreading of developer.

BRIEF DESCRIPTION OF THE DRAWINGS

The invention will be described hereinafter by way of example with reference to the accompanying drawings wherein.

DETAILED DESCRIPTION OF THE INVENTION

Figure 1:
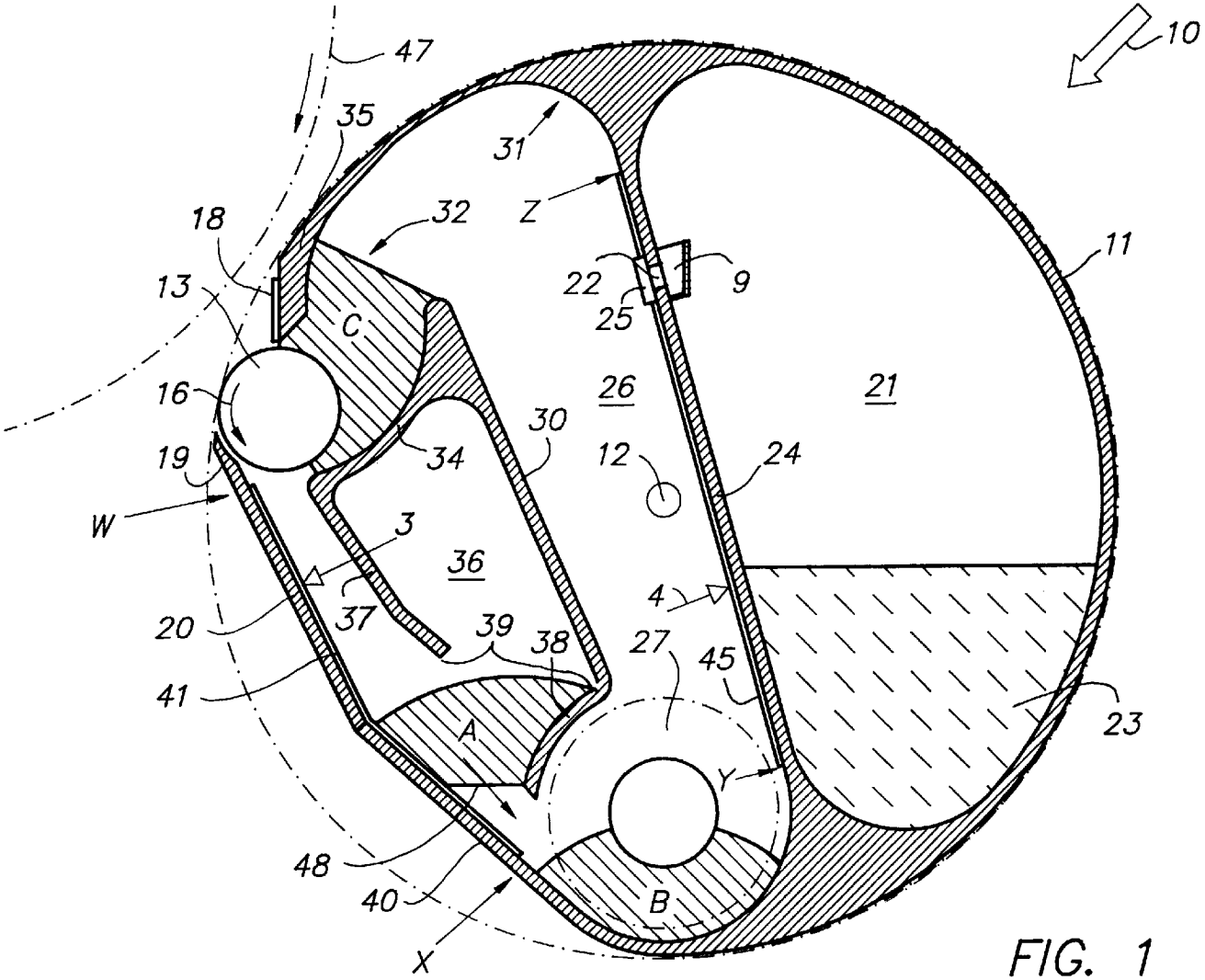
FIG. 1 is a diagrammatic cross-sectional view of one embodiment of a device according to the invention, shown in the developing position, just after a previous rotation over 360°, or just before starting printing.

The developing device indicated by arrow 10 in FIG. 1 is mounted in a generally cyclindrical housing 11, except for the lower left-hand portion in this figure which is flattened, and is mounted for rotation around a horizontal shaft 12. The means for rotating the housing and for securing its operational developing position as shown in FIG. 1 are not illustrated.

Figure 2:
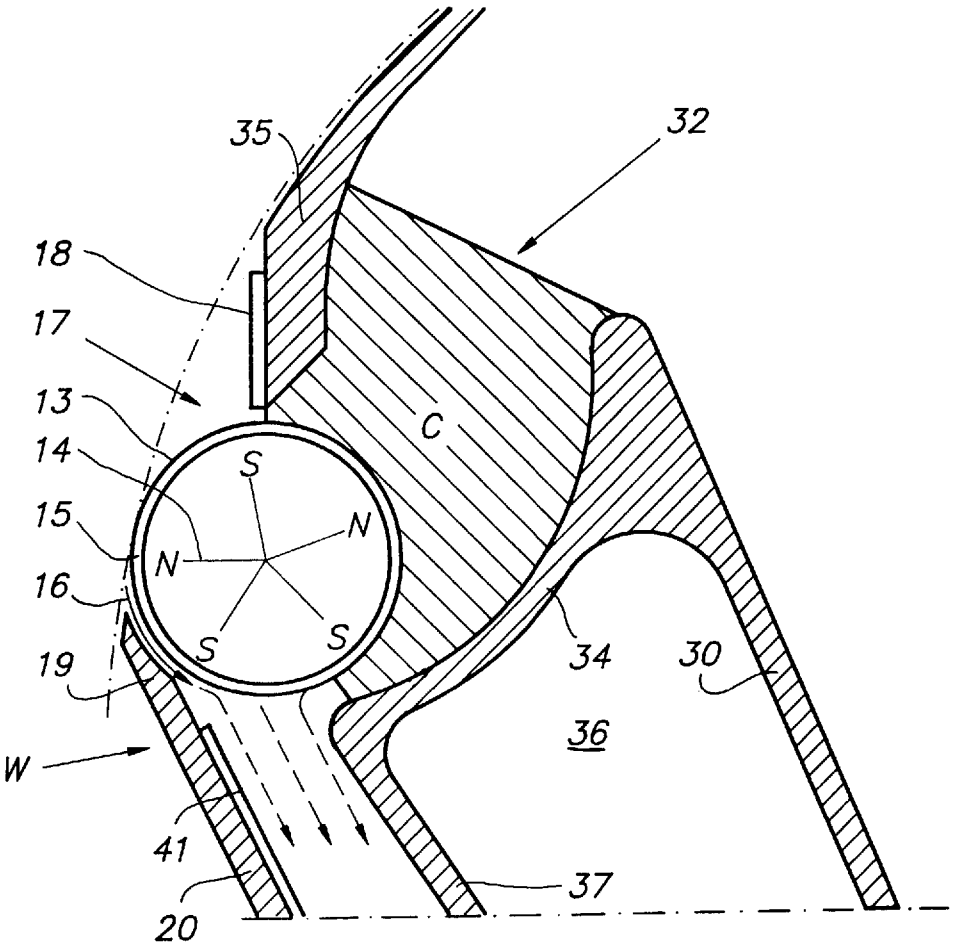
FIG. 2 is an enlarged view of magnet roller 13 of FIG. 1.

A developer roller 13 comprises a stationary magnet arrangement 14, see FIG. 2, around which a non-ferromagnetic sleeve 15, e.g. made from aluminium or stainless steel, is rotatable in the direction of arrow 16 by suitable driving means. The developer roller is mounted within an elongated peripheral opening 17 of the housing and extends parallel to shaft 12. This opening is determined by a doctor blade 18 mounted on the peripheral wall portion 35 of the housing on the one hand and by a tapered end 19 of wall 20 on the other hand.

The housing has a chamber 21 containing an amount of toner 23. This chamber is determined by a cyclindrical wall portion of the housing and an inner wall 24. Wall 24 is provided with a small dosage cup 9, open at the top according to the view of FIG. 1, which communicates with the opposite side of wall 24 via an opening 22. A valve 25, shown diagrammatically by a rectangle, can close the opening. Means known in the art such as levers or a solenoid control the opening of the valve through which toner can be added to developer in developer chamber 26. The lowest part of this chamber comprises a mixer 27 for mixing and stirring the developer. The length of the mixer amounts approximately 30 to 70% the length of developer roller 13. The mixer can be formed by a screw feed roller comprising two sections with opposite feeding directions, which thoroughly can mix and stir a developer in order to electrostatically charge it and also to obtain a uniform distribution of toner. The central portion of developer chamber 26 has nearly parallel walls 24 and 30, whereas the portion remote of the mixer has a curved shape determined by curved wall 31 leading developer in the direction of hopper 32 for developer roller 13.

Hopper 32 is determined by wall section 34 and a corresponding portion 35 of the peripheral wall of the housing.

Finally, the housing has a chamber 36 for used developer, which is formed by walls 34, 37, 30 and 38, an opening 39 between walls 37 and 38 forming the inlet and outlet of this chamber.

The device is provided with rib means controlling the lateral flow of developer during rotation of the device.

Figure 3:
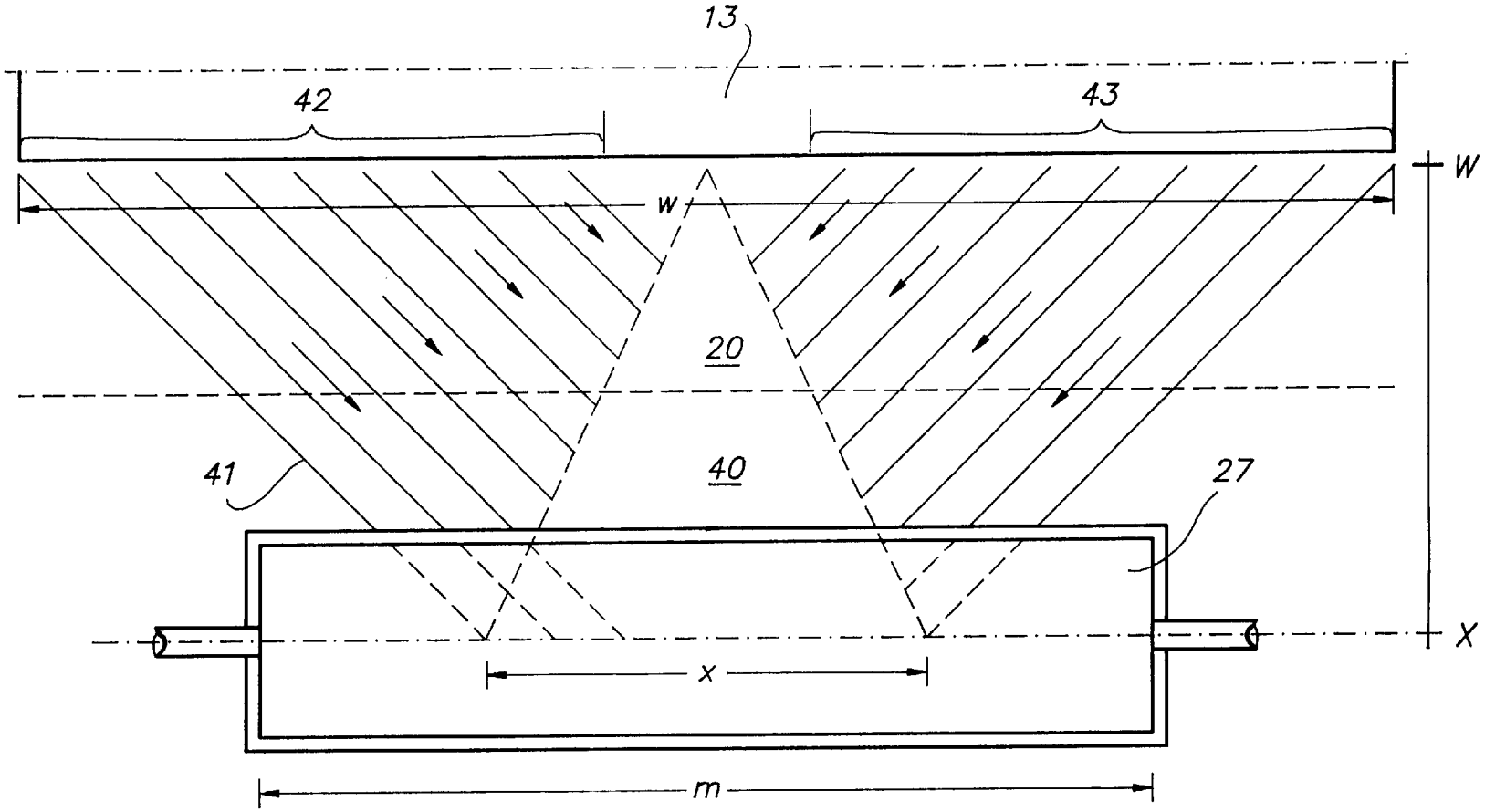
FIG. 3 is a view on arrow 3 of FIG. 1.

First ribs 41 are provided on the inside surface of walls 20 and 40 as shown in FIG. 3 which is a view on this surface between positions W and X. The ribs can have a height of some millimeters and are divided in two groups 42 and 43 which converge towards each other in the developer transport direction from magnet roller 13 towards mixer 27. This arrangement produces a given amount of cross-mixing which facilitates the later mixing, and is important in case the toner depletion is unilateral, e.g. a 50% area coverage at the left versus a 5% coverage at the right-hand half of the print. The width of the rib pattern at the magnet roller is indicated by w, at the mixer by x.

Figure 4:
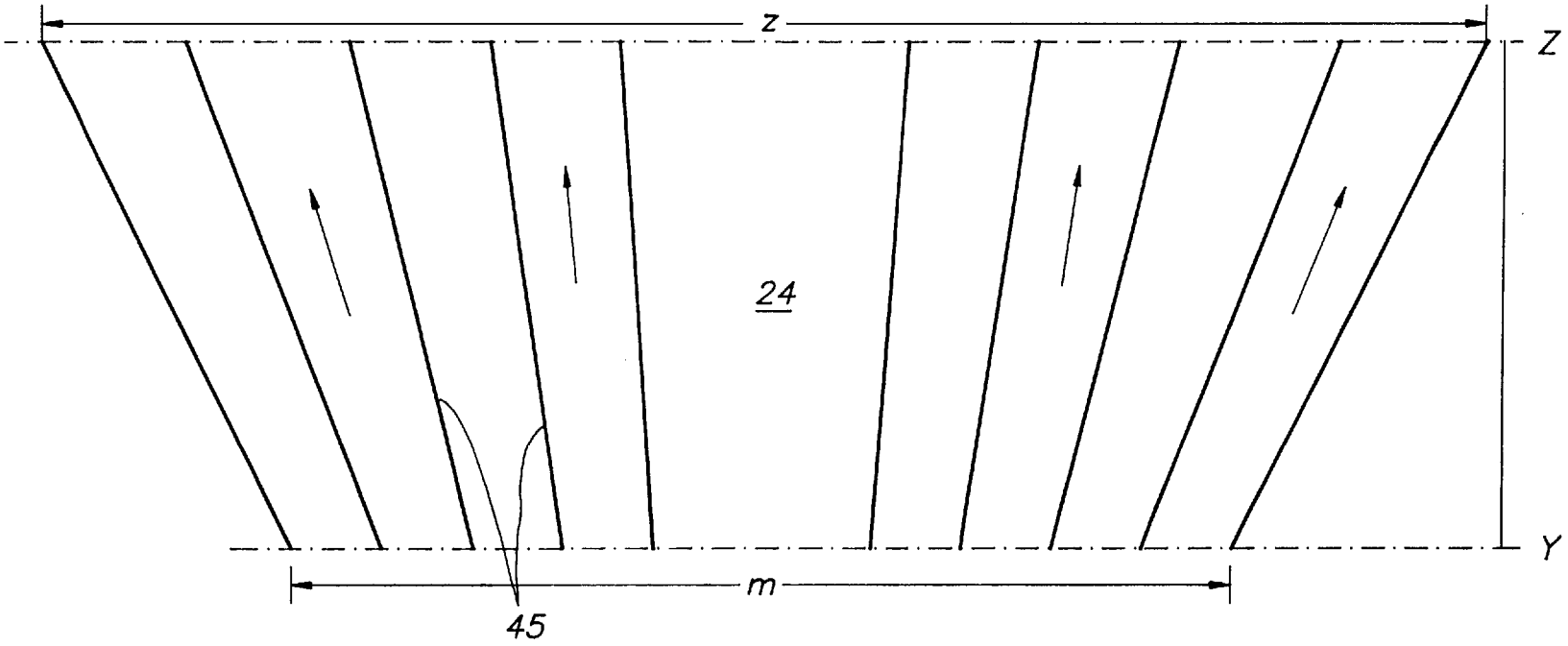
FIG. 4 is a view on arrow 4 of FIG. 1.

Second ribs 45 are provided on that surface of wall 24 which is inside developing chamber 26, as shown in FIG. 4 which is a view on said surface according to arrow 4 between positions Y and Z. The ribs diverge in the developer transport direction as shown by the arrows, and the width of the rib pattern is m at Y and z at Z.

The device finally comprises means, known in the art, for measuring the toner concentration of the developer and controlling the addition of toner to depleted developer in due time.

The operation of the device is described hereinafter by way of example.

The device being in the position as shown in FIG. 1, and hopper 32 containing an amount C of fresh developer which is twice the amount of a given format, e.g. an A3 format, the support carrying the electrostatic charge image, e.g. a semiconductor drum, is conveyed along a path indicated by dashed line 47 in close proximity of magnet roller 13. The developer roller rotating in the direction of arrow 16 establishes a magnetic brush the thickness of which is controlled by doctor blade 18. The brush is capable of satisfactory developing the electrostatic image at any instance with a constant density, even with a 100% area coverage since at the one hand used developer is completely removed from the roller near its lowest point because the two adjacent S-poles of the magnet arrangement cause a dip in the field whereby the developer is no longer held attracted to sleeve 15 so that it completely falls of the roller within the space between walls 20 and 37, and at the other hand fresh developer is continuously supplied to magnet roll from hopper 32. Used developer from a previous development is indicated by A, whereas the amount of developer contained in mixer 27 is B. Developer A will slide in mixer 27 and become added to the amount B. Since the width x at point X is reduced, it is desirable to start the rotation of mixer 27 some time, e.g. 1 sec, before that of the magnet roller so that used developer section 36 is empty.

Figure 5:
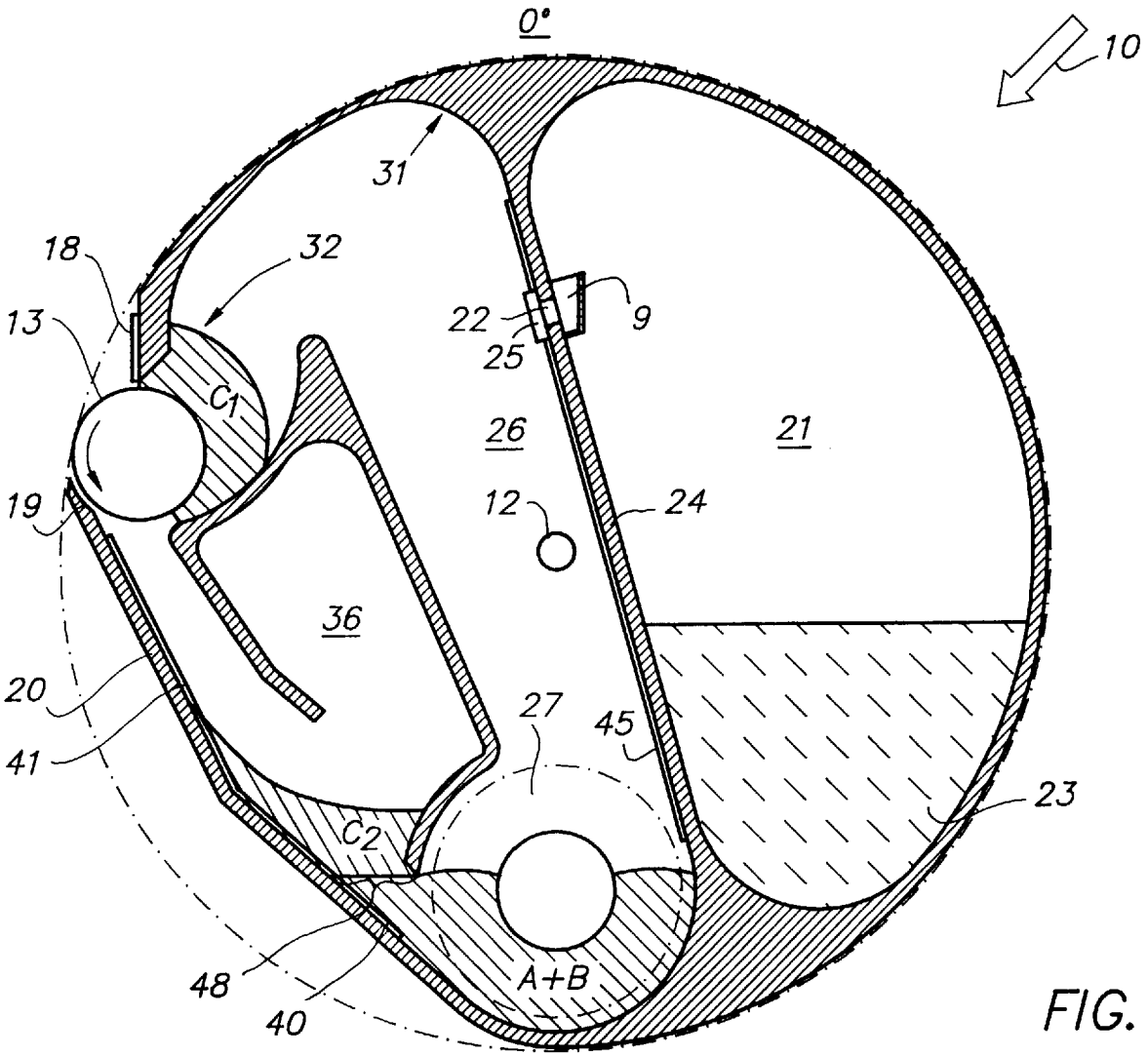
FIG. 5 is a view of the device according to FIG. 1, after the complete development of a charge image.

The developer quantities after the image has been completely developed and magnet roller 13 has been stopped are shown in FIG. 5. The amount of fresh developer remaining in hopper 32 is $C_1$. Used developer, i.e. $C_2$ removed from the magnet roller, is now in chamber 36. It is desirable that developer $C_2$ should not have come in this stage already in mixer 27. This can be obtained by having opening 48 closed by a suitable level of developer (A+B) in the mixer, or by the provision of a suitable valve in this opening for temporarily closing it.

Figure 6:
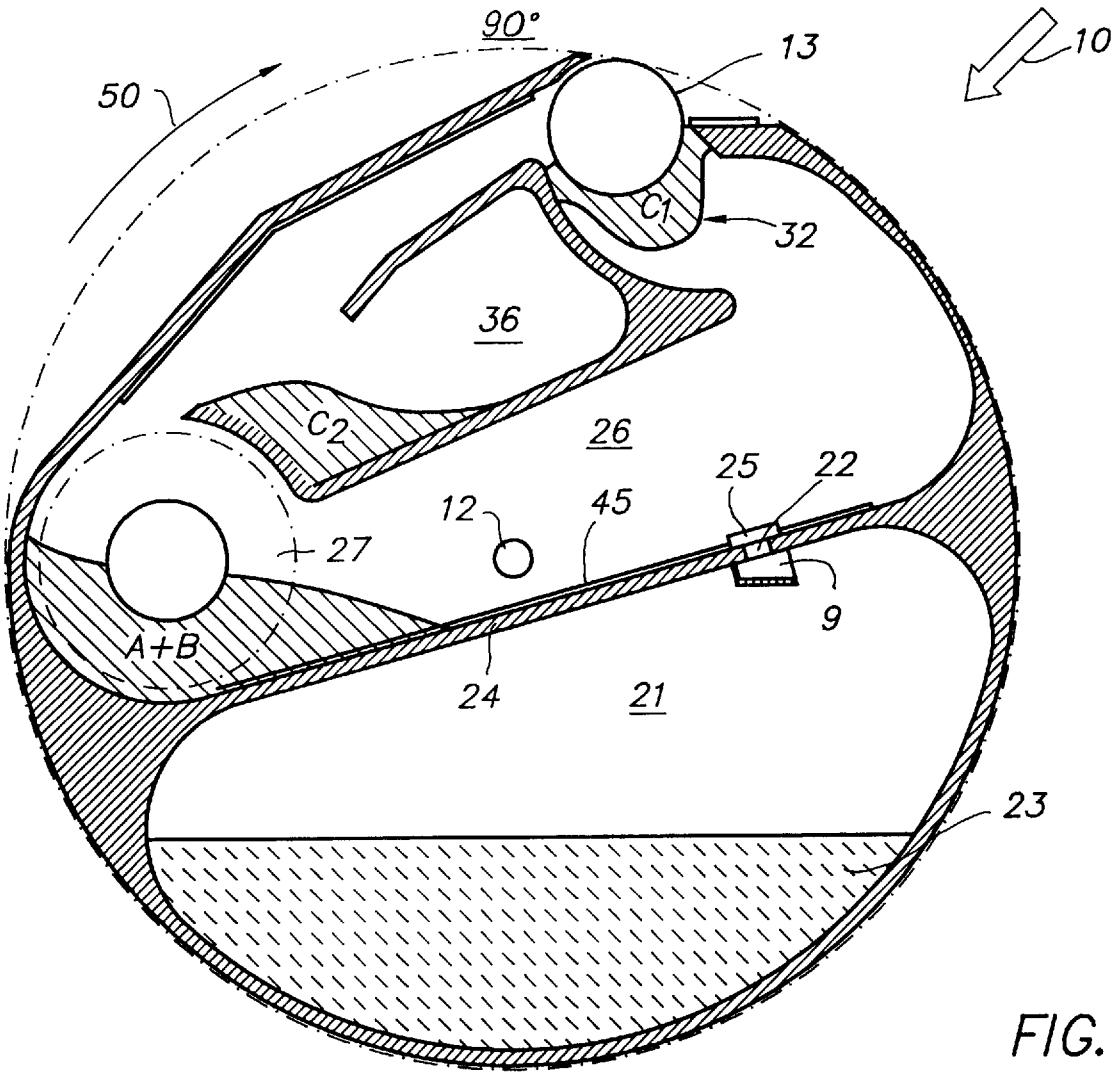
FIG. 6 is a diagrammatic cross-sectional view of the device according to FIG. 1, rotated over 90° in clock-wise direction.

FIG. 6 shows the developer position after rotation of the device over 90° as indicated by arrow 50. In addition to the mixing, the mixer has also a spreading action on the developer mass since developer entered the mixer at a width x and left it at a width m, see FIG. 3. Further spreading of the developer mass will occur by transport along wall 24, ribs 45 causing a further spreading from an entrance width m at Y to a width z at Z, see FIGS. 1 and 4.

Figure 7:
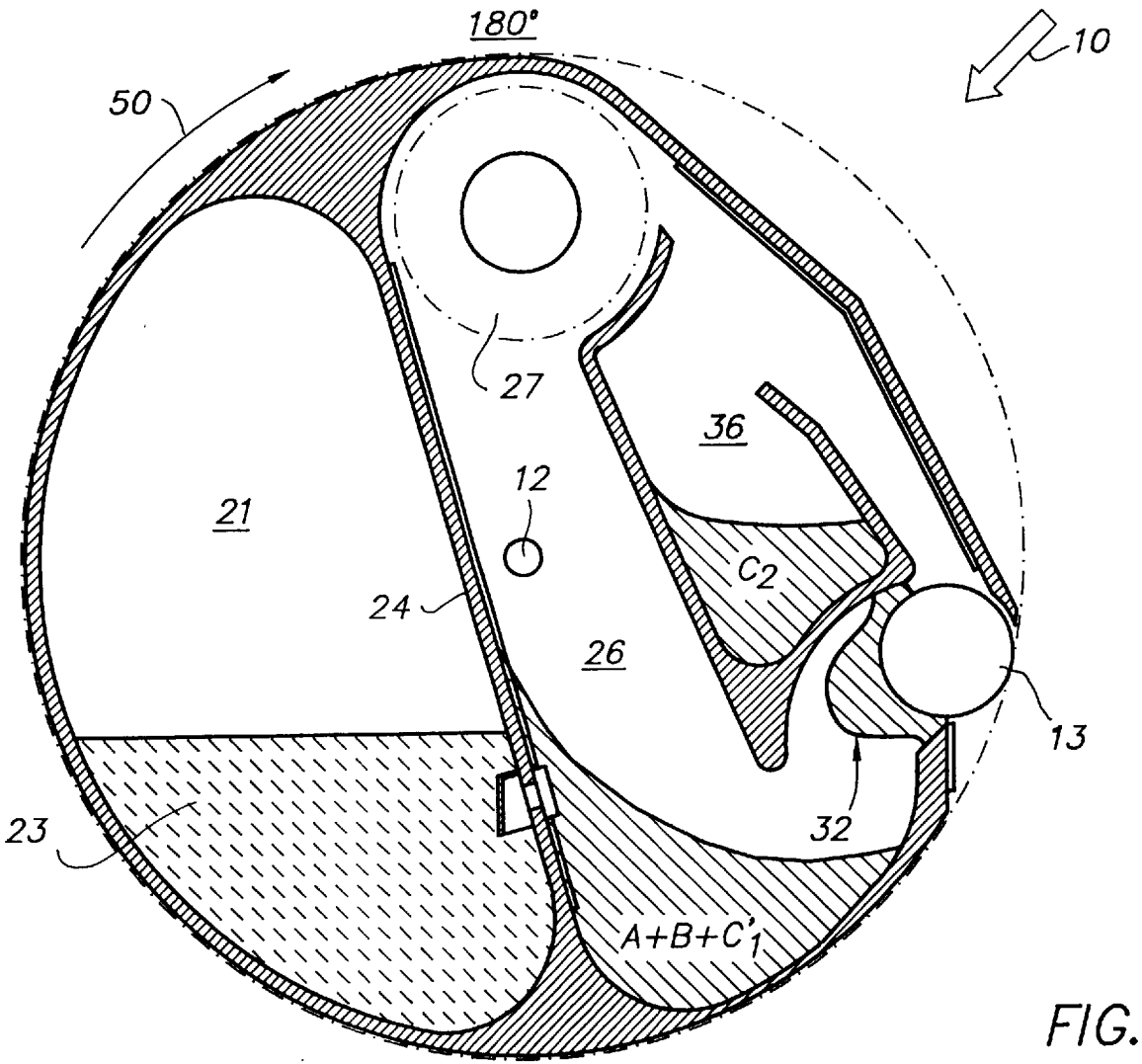
FIG. 7 is a diagrammatic cross-sectional view of the device according to FIG. 1, rotated over 180° in clock-wise direction.

FIG. 7 shows the situation after a 180° rotation of device 10. The amount of fresh developer present in developer chamber 26 now amounts to $A+B+C_1'$, $C_1'$ being a part of $C_1$ in hopper 32. Mixer 27 has been completely emptied.

Developer $C_2$ removed from the magnet roller during the development, is now collected in reversed chamber 36.

Figure 8:
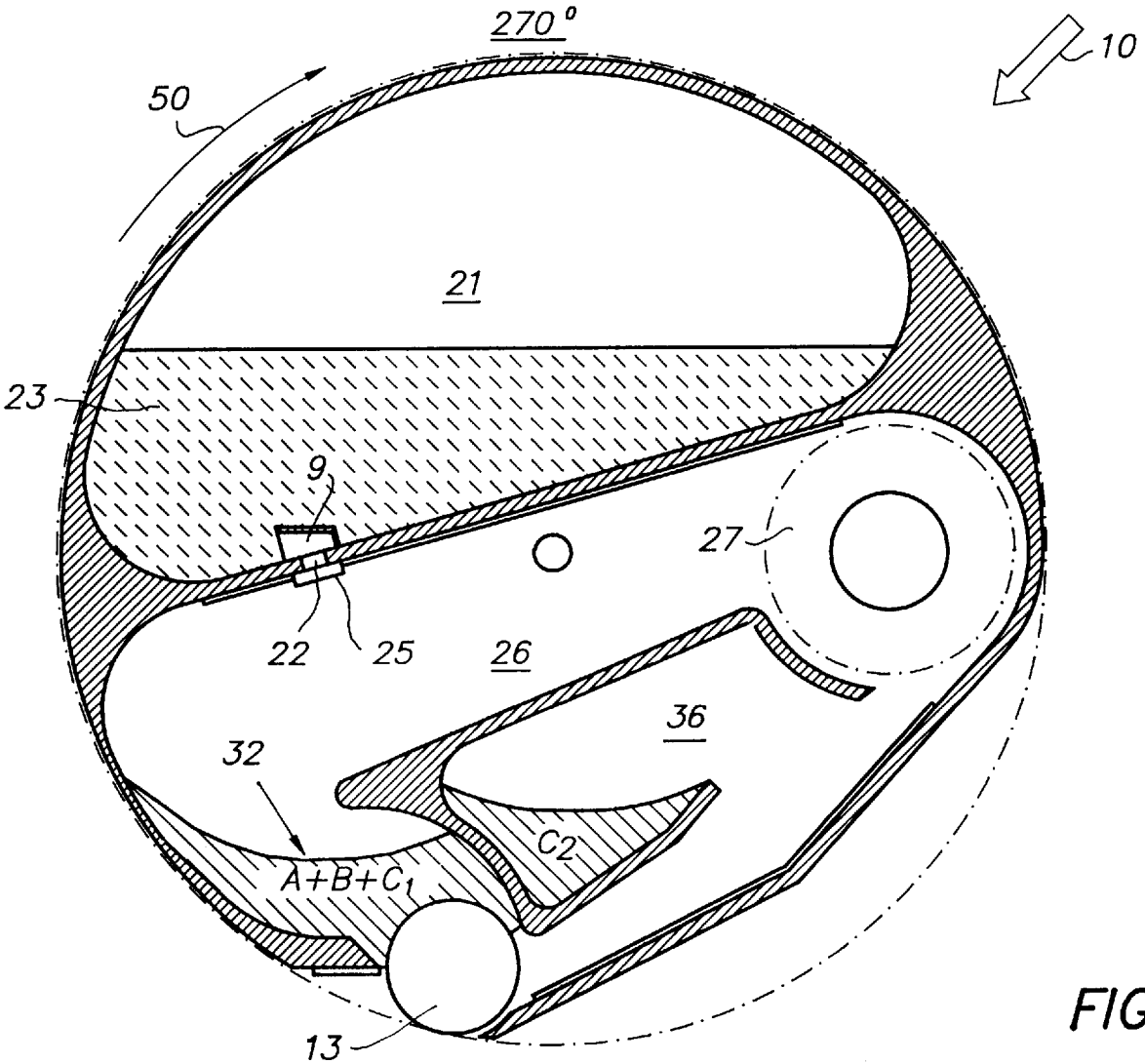
FIG. 8 is a diagrammatic cross-sectional view of the device according to FIG. 1, rotated over 270° in clock-wise direction.

FIG. 8 shows the device after a 270° rotation.

The amount of fresh developer in hopper 32 and near the entrance thereof now amounts to $A+B+C_1=D$.

Figure 9:
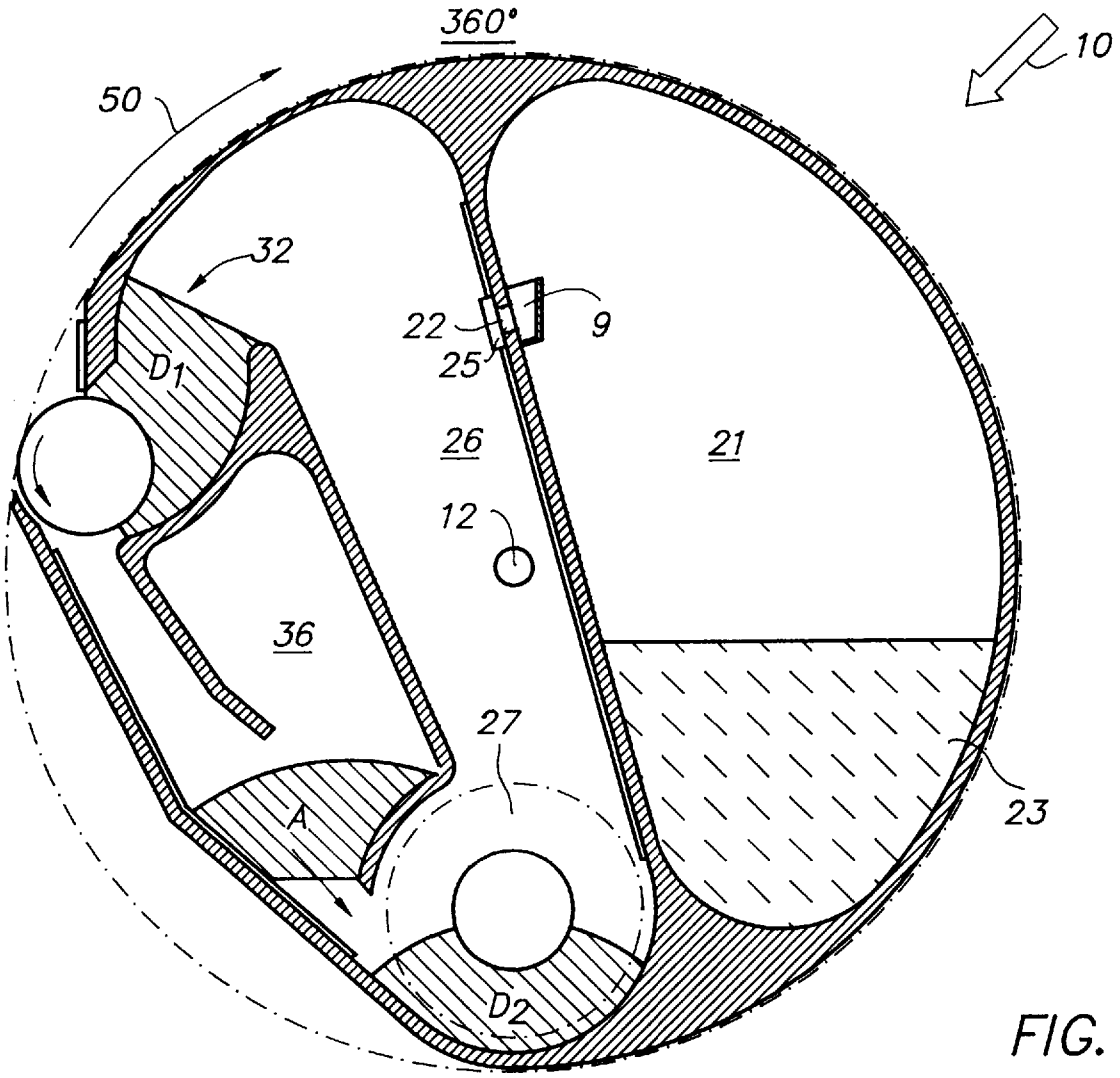
FIG. 9 is a diagrammatic cross-sectional view of the device according to FIG. 1, rotated over 360° in clock-wise direction, whereby the device is in the developing position again.

Finally, FIG. 9 shows the device after a rotation over 360°. The amount of developer in hopper 32 is $D_1$, whereas the amount in mixer 27 is $D_2$ ($D=D_1+D_2$). The dosage cup becomes filled between 270° and 360°. Valve 25 can now be opened to supply the toner dose of cup 9 to chamber 26 and so to mixer 27, as shown in dashed lines 33. Control of valve 25 entirely depends on the consumption of toner, i.e. the area coverage of the image, and thus it can well occur that opening of valve 25 has only to occur after a number of images has been developed. The advantage of the described toner addition system is that it is based on a constant dose, depending on the volume of dosage reservoir 9, whereby a greater accuracy may be obtained than with common time-controlled valves.

The following example illustrates the device described hereinbefore.

Operation developer width 30 cm

Largest image format: A3

Developer quantities (indicative) for A3 format

A 200 mg

B 250 mg

C 450 mg $C_1$(=C−A) or (C−$C_2$) 250 mg $C_1$50 to 100 mg $C_2$200 mg D=A+B+$C_1$700 mg Dosage reservoir 9 100 mg A device according to the present invention is not limited to the embodiment described hereinbefore.

Toner addition can occur also by means of more than one cup. E.g. two cups, one measuring 200 and the other 400 mg, together offer dosage possibilities of 200, 400 or 600 mg/print, respectively.

Three cups, e.g. 100, 200 and 400 mg, offer toner dosages of 100, 200, 300, 400, 500, 600 and 700 mg/print, respectively. This may be required since different batches of developer may be encountered which yet must be kept at a constant toner concentration.

Further it is also possible to replace the mechanical valve described hereinbefore by a magnetic plug for opening and closing the opening. Suchlike system is disclosed in our co-pending application entitled: "Electrostatographic developing device with toner dosage reservoir", filed on even day herewith.

The present example related to black-and-white development. For colour work, four developing devices are required to develop yellow, cyan, magenta and black-and-white separation images in succession.

Toner chamber 21 has been shown in the drawings without any opening for filling or emptying. It is clear that in practice the toner will be contained in a cartridge which duly fits in this chamber.

The removal of used toner from the magnet roller does not necessarily depend on the magnet construction of the roller and thus it is possible to carry out such removal also by means of an appropriate scaper blade.

Figure 10:
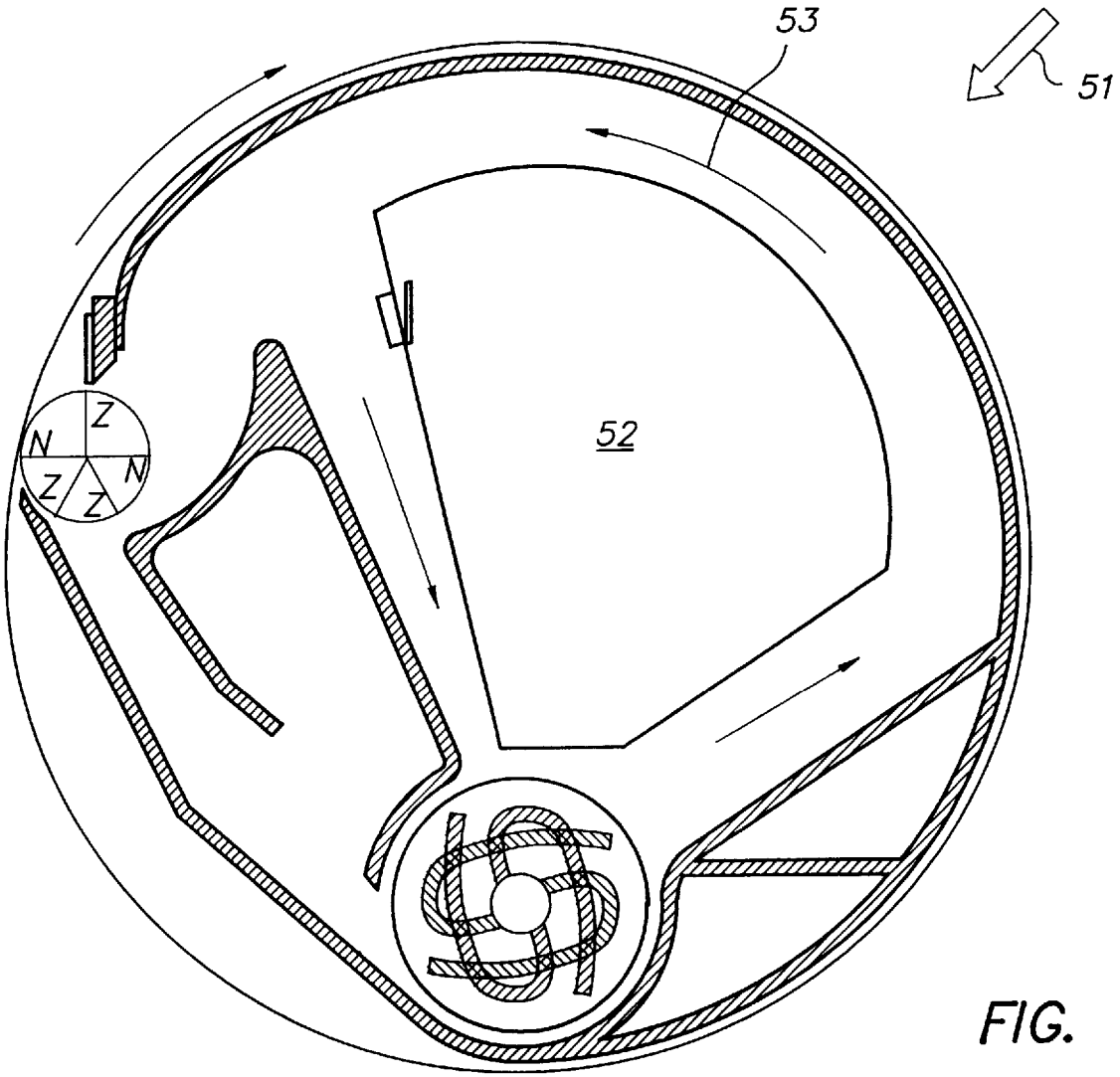
FIG. 10 is a diagrammatic cross-sectional view of a second embodiment of a device according to the invention.
Figure 11:
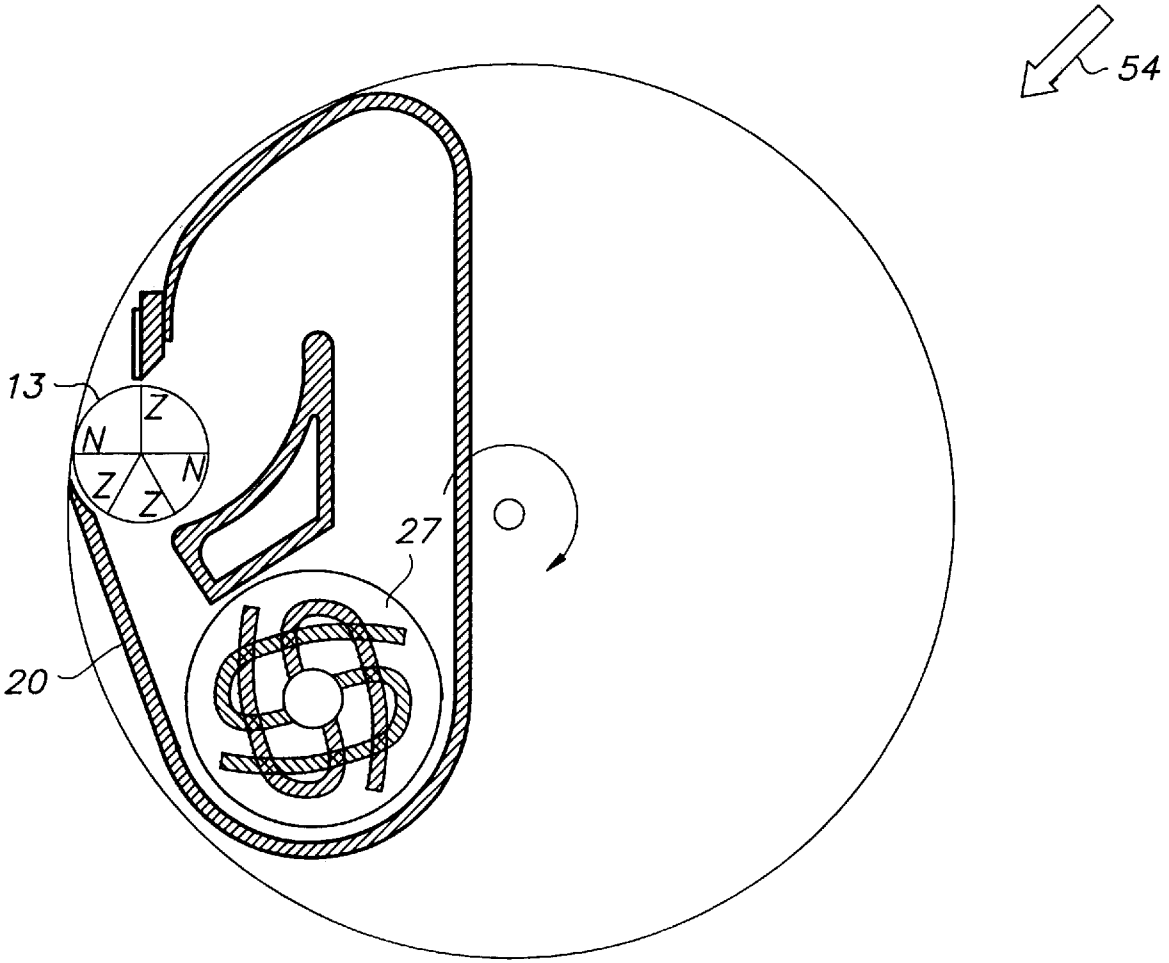
FIG. 11 is a diagrammatic cross-sectional view of a third embodiment of device according to the invention.
Figure 12:
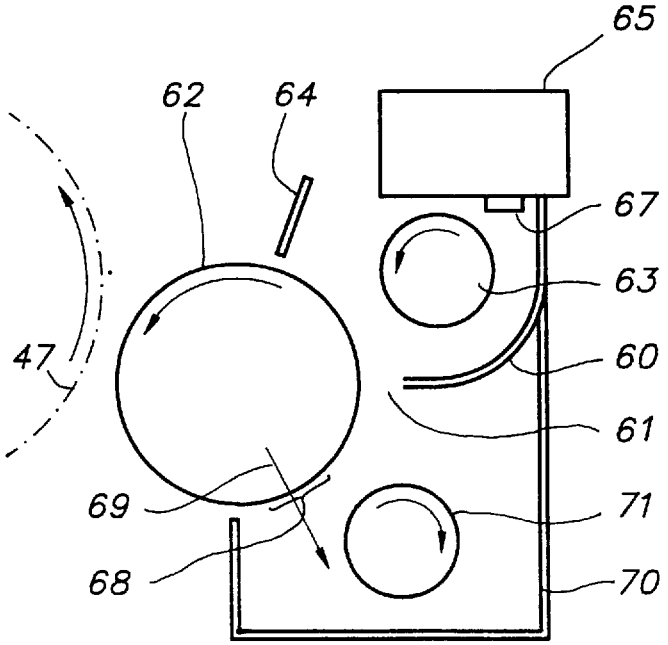
FIG. 12 is a diagrammatic cross-sectional view of a fourth embodiment according to the invention.

Other embodiments of a device according to the invention are illustrated in FIG. 10 to 12.

Referring to FIG. 10, device 51 according to this embodiment has a toner chamber 52 allowing developer to pass around this chamber during rotation of the device, as indicated by the arrow 53. The advantage is a more extended cross-mix length for the developer during rotation of the device.

FIG. 11 shows an embodiment 54 without a chamber for used developer, such as chamber 36 of FIG. 2. The advantage is a more compact construction but it will be understood that since there is less centralising of the used developer on front wall 20, mixer 27 must have a greater cross-mixing capacity for left-to-right.

FIG. 12 shows an embodiment of the invention which has more resemblance with prior art devices than the foregoing embodiments.

The device comprises a holder 60 which has a tray-like cross-section, its front edge 61 being closely spaced from from magnet roller 62. A helical feed screw 63 rotating in holder 60 ensures the transport of developer along the length of the holder and provides a buffer of fresh developer from which the magnet roller can pick up a layer of sufficient thickness. The aimed thickness of the developer layer is controlled by a doctor blade 64. A holder 65 for toner has a valve 67 for adding toner to the developer mass of the system. Magnet roller 62 can have a magnet arrangement as described for the embodiments hereinbefore, so that at angular area 68 the developer is no longer attracted to the magnet roller but falls as indicated by arrow 69 in a feed passage 70 in which a second feed screw 71 rotates to transport the developer in a direction opposite to that of feed screw 63. At the end of the course of feed screw 63 the developer can be transported upwardly by means of any arrangement known in the art so as to get in the entry end of holder 60. It is clear that also in this device there occurs a complete replenishing of the layer of developer at each revolution of the magnet roller. Mixing of added toner with developer can occur by feed screws 63 and 71.

We claim:

1. An electrostatographic developing device, comprising:

a housing rotatably mounted on a horizontal shaft, said housing having an elongated peripheral opening;

a developer roller rotatably mounted in said elongated peripheral opening, said developer roller having a peripheral surface for holding thereon a magnetically attractable dry powder developer for use in developing an electrostatic image formed on an electrostatic image support member passed in close proximity to said developer roller;

a toner chamber in said housing for holding toner;

a developer chamber in said housing for holding developer;

means for adding said toner stored in said toner chamber to said developer stored in said developer chamber;

means for providing fresh developer to said developer roller;

means for completely removing used developer from said developer roller at a location downstream in the rotational direction of said developer roller from the location where said developer roller passes in close proximity to said electrostatic image support member to develop said electrostatic image, but upstream in said rotational direction from the location where said fresh developer is provided to said developer roller, said used developer being formed from said fresh developer being used to develop said electrostatic image on said electrostatic image support member;

a receiving chamber mounted in said housing for receiving said used developer after it has been removed from said developer roller; and mixing means located in said developer chamber for mixing said used developer and said toner with said developer located in said developer chamber to form said fresh developer.

2. The electrostatographic developing device according to claim 1, wherein said elongated peripheral opening is located in a flattened peripheral wall portion of said housing, and wherein said receiving chamber for receiving said used developer further comprises an opening providing an inlet and outlet for said used developer, said opening extending downward inside the portion of said housing having said flattened peripheral wall.

3. The electrostatographic developing device according to claim 2, further comprising a passage for guiding said used developer away from said developer roller to said receiving chamber, said passage being formed by an upper wall and a lower wall, said lower wall being positioned below said upper wall when said used developer is removed from said developer roller, said lower wall having ribs which converge downward, thereby causing said used developer to concentrate toward the central portion of said passage.

4. The electrostatographic developing device according to claim 3, wherein said developer chamber is formed by a first wall and a second wall, said first wall being positioned below said second wall when said housing is rotated so that said developer in said developer chamber is moved by gravity away from said mixing means toward said developer roller, said first wall having rib means diverging in the direction of movement of said developer away from said mixing means toward said developer roller, thereby causing a lateral spreading of said developer as said developer moves away from said mixing means toward said developer roller.

5. The electrostatographic developing device according to claim 1, wherein said means for providing said fresh developer to said developer roller comprises a hopper formed by a first wall and a second wall in said housing, said hopper being capable of holding an amount of said fresh developer sufficient for developing at least one said electrostatic image on said electrostatic image support member.

* * * * *